United States Patent [19]

Jones, deceased et al.

[11] Patent Number: 4,956,964

[45] Date of Patent: Sep. 18, 1990

[54] ADJUSTABLE POUCH FORM, FILL, SEAL MACHINE

[75] Inventors: Wickliffe Jones, deceased, late of Cincinnati, Ohio, by Martha W. Jones, Executrix; Eric W. Scarpa, Cincinnati, Ohio; Joseph D. Greenwell, Florence, Ky.; Mark R. Nease, Lakeside Park, Ky.; Robert M. Kalany, Florence, Ky.; Michael E. Myers, Bellevue, Ky.

[73] Assignee: R. A. Jones & Co. Inc., Covington, Ky.

[21] Appl. No.: 323,365

[22] Filed: Mar. 13, 1989

[51] Int. Cl.[5] ..... B65B 43/26

[52] U.S. Cl. ..... 53/570; 53/384; 53/562; 198/803.9

[58] Field of Search ..... 53/373, 384, 386, 512, 53/562, 564, 570, 571; 198/803.9

[56] References Cited

U.S. PATENT DOCUMENTS

| | | | |
|---|---|---|---|
| 2,269,532 | 1/1942 | Howard | 53/455 |
| 3,182,432 | 5/1965 | Canfield | 53/512 |
| 3,230,687 | 1/1966 | Nutting et al. | 53/562 |
| 3,340,679 | 9/1967 | Johnson | 53/385 |
| 3,381,446 | 5/1968 | Marchand | 53/562 |
| 3,430,414 | 3/1969 | Ludwig et al. | 53/79 |
| 3,568,402 | 3/1971 | Lense et al. | 53/384 |
| 3,708,952 | 1/1973 | Schulze et al. | 53/512 |
| 3,855,907 | 12/1974 | Johnson et al. | 53/570 X |
| 4,033,093 | 7/1977 | Mencacci | 53/512 |
| 4,156,336 | 5/1979 | Tabaroni et al. | 53/562 |
| 4,306,400 | 12/1981 | Coleman et al. | 53/373 |
| 4,353,198 | 10/1982 | Koppe | 53/570 |
| 4,418,512 | 12/1983 | Johnson | 53/434 |
| 4,736,572 | 4/1988 | Fang et al. | 53/564 X |

*Primary Examiner*—Robert L. Spruill
*Assistant Examiner*—Beth Bianca
*Attorney, Agent, or Firm*—Wood, Herron & Evans

[57] ABSTRACT

A web is folded upon itself and transversely sealed. The web is cut into individual pouches which are fed into gripper units, on an endless conveyor, each having a fixed leading jaw and a movable trailing jaw which grip the leading and trailing edges of the pouches. To open a pouch, the trailing jaw is moved toward the fixed jaw by a cam and held in position by friction. Each opened pouch is carried around a filler unit where it is filled. Thereafter, a cam causes said jaws to spread apart, stretching the mouth of the pouch, where it is sealed in a heat sealer.

13 Claims, 8 Drawing Sheets

ADJUSTABLE POUCH FORM, FILL, SEAL MACHINE

BACKGROUND OF THE INVENTION

This invention relates to a pouch form, fill, seal machine and particularly to a machine that can easily be adjusted to accommodate pouches of various lengths, the length being the dimension in the direction of movement of the pouch on the machine.

Pouch form, fill, seal machines have been known for many years. In such machines, a continuous web is folded in half over a generally triangular plow. The folded web is fed around a drum having heated lands, the heated lands making transverse seals of thermoplastic material from which the pouch is formed or laminated. That sealed web is fed to a filling drum that has uniformly spaced lands around its perimeter. A registration device operating from a registration mark printed on the web maintains a registration of the seals centered on the lands of the filling drum. In the filler, the pouches are filled. Immediately thereafter, they are sealed and cut into individual pouches and fed to cartoning machines.

Such machines are suitable for forming, filling, and sealing only one size pouch. To change to another size pouch would require, among other things, a different sealing drum and a different filler. The change parts are so expensive that it is pointless to attempt to run different sizes of pouches and, hence, different products on one machine. A manufacturer with a product mix requiring different sizes pouches will have a different size machine for each size pouch.

Manufacturers having a varied product mix that is packaged in various sizes of pouches would be greatly benefitted by a machine capable of running various sizes of pouches with the conversion being capable of being made from one size to the other without great expense.

Registration of the pouch seams to a cutting knife is very important. Not only must the cut be made on the seam to avoid pouch rupture, but it is also important to make the cut on the center of the seam between pouches so that the edges on each side of the pouch are of a uniform width to insure an aesthetically appealling pouch.

With an adjustable pouch machine, the wide variety of sizes of pouches and thicknesses of pouch, as determined to some extent by product density, makes registration a problem. Further, if the pouch is unprinted, a special operation would be required to print a registration mark on the pouch if current registration systems are to be used.

SUMMARY OF THE INVENTION

It has been an objective of the present invention to provide a pouch machine which is adjustable to run pouches over a wide range of lengths.

It has been another objective of the invention to provide a pouch machine with an improved registration system which requires no preprinted registration mark.

The objective of providing an adjustable pouch machine is attained in part by providing a gripper unit having two jaws between which each pouch is carried, a plurality of gripper units being mounted on an endless chain conveyor in uniformly-spaced relation. In the gripper unit of the present invention, the leading jaw is fixed and the trailing jaw is movable. The jaws are maintained parallel to each other regardless of the amount of separation between them. The trailing jaw is slidably mounted on rods and is frictionally retained in the position to which it is slid on the rods. Grease seals are used to form the frictional connection of the jaws to the rods.

The trailing jaw has two actuators pivoted on the gripper frame. The leading actuator, when engaged by an upwardly-inclined ramp, causes the trailing jaw to retract. When the trailing actuator rides upwardly upon a ramp, the trailing jaw advances toward the fixed jaw.

The apparatus provides as many ramps as are needed for the complete sequence of operations, all ramps being identical. In the preferred form of the invention, the sequence of operations includes the following:

With the jaws open wider than the length of the pouch, the pouch is brought up to the leading jaw at a velocity slightly greater than the velocity of the gripper unit so that the pouch buckles slightly as it engages the leading jaw. A ramp engages the trailing jaw actuator and advances it to grasp the trailing edge of the pouch.

As the pouch is carried through an opener, the trailing jaw actuator engages another ramp to advance the trailing jaw to the position for full opening of the pouch while air is blown across the face of the pouch to open it. The jaws frictionally remain in this attitude through the filling operation. After the filling operation, the trailing jaw is retracted to stretch the top or mouth of the pouch taut while it is carried through a sealer.

After being sealed, the pouches are discharged and the trailing jaw is further retracted by a final ramp.

Each ramp is preferably adjustable horizontally to adjust the timing of the occurrence of jaw movement and adjustable vertically to determine the amount of jaw movement. The adjustments are preferably done with hand knobs and digital counters so that settings can be made and obtained repeatedly for the various pouch sizes.

Registration is attained without the need of a registration mark through the use of a "walking star wheel." The walking star wheel has a plurality of legs that enter, one leg per pouch, into the mouth of the pouch as the web of pouches passes under the walking star. The walking star is caused to rotate by engagement of the trailing seal of each pouch as it pushes on the walking star. Thus, the rotary position of the walking star is precisely related to the position of the seal. In accordance with the present invention, a sensor determines the position of the walking star and uses that to control the registration of the web to the cut-off knife.

A final important feature of the present invention relates to the capability of running pouches of different height wherein webs having differing widths would be fed into the system. Each web must be centered to the folding plow. In accordance with the invention, the supply rolls are all mounted on the stand with the inner faces of the rolls always mounted to the same position. The web is passed over a right angle turning bar. By adjusting the position of the turning bar, the web can be centered over the plow adjacent the turning bar.

BRIEF DESCRIPTION OF THE DRAWINGS

The several objectives and features of the present invention will become more readily apparent from the following detailed description taken in conjunction with the accompanying drawings in which.

DETAILED DESCRIPTION OF THE DRAWINGS

General Organization and Operation

Figure 1:
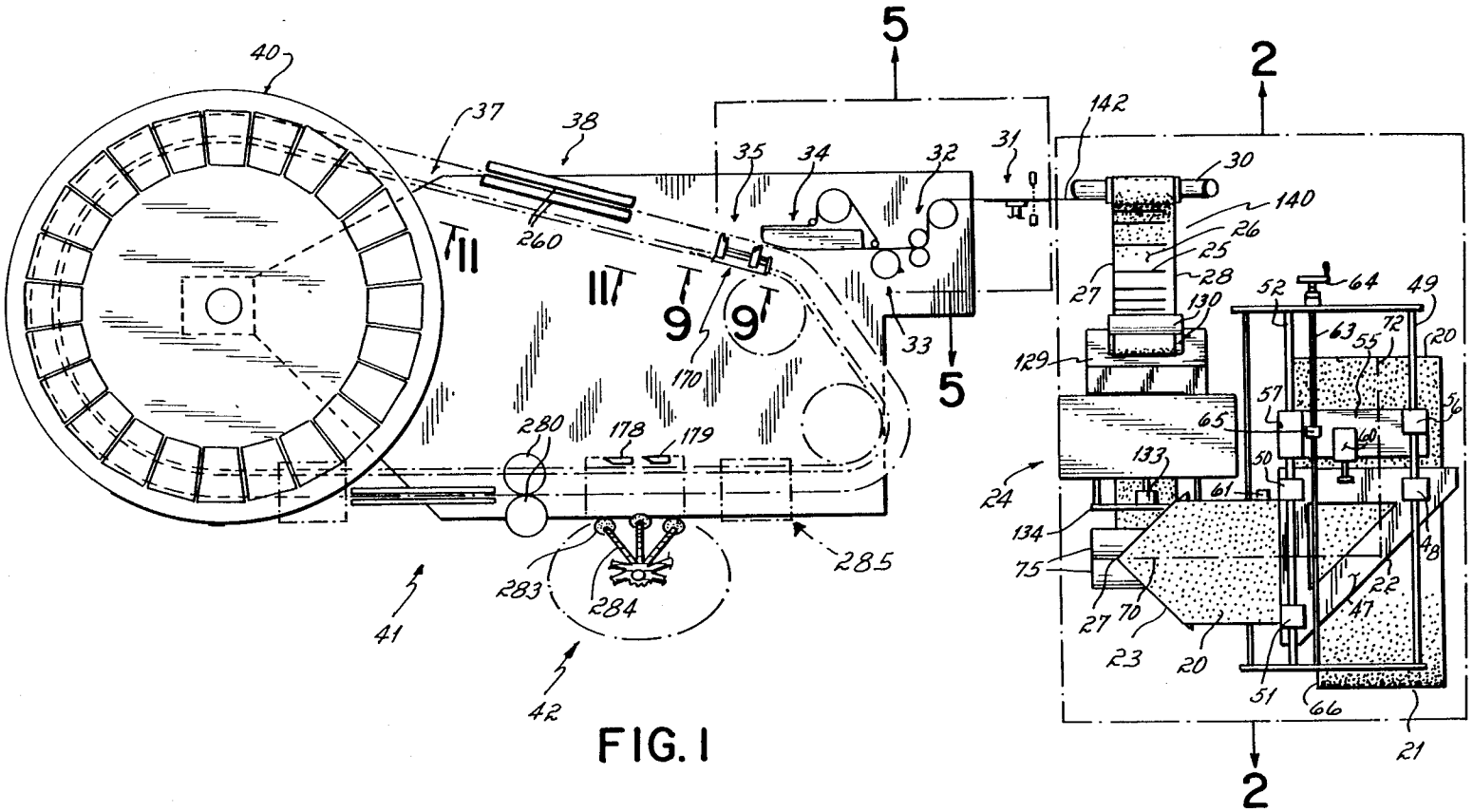
FIG. 1 is a diagrammatic top plan view of the apparatus of the present invention.

Referring to FIG. 1, a web 20 is fed from a supply roll 21 over a turning bar 22 across a triangular plow 23. At the plow, the web is folded upon itself. The folded web passes through a transverse sealing station 24 where it receives transverse seals or seams 25, thereby defining interconnected pouches 26 having a folded bottom edge 27 and an open mouth 28. The web is fed over another turning bar 30, orienting the pouch mouths 28 at the top of the web. After passing the turning bar 30, the web is in a vertical attitude and is engaged by a walking star 31 having an electric eye position sensor that is connected to registration rolls 32. The registration rolls advance or retard the web as it is fed into rotary knife 33 to be sure that the pouches are cut through the center of the seams 25. A vacuum conveyor 34 conveys the pouches into the leading jaw of a gripper 35 (FIG. 5) where it is gripped. Thereafter, the trailing edge of the pouch is gripped by a trailing jaw of the gripper and conveyed by an endless chain conveyor 37. The pouch is conveyed through an opening station 38 and then around a filler 40. After the pouch is filled, it is closed and sealed at a closing and sealing station 41. The pouch is then discharged at a discharge station 42.

Turning Bar

Figures 2, 4A:
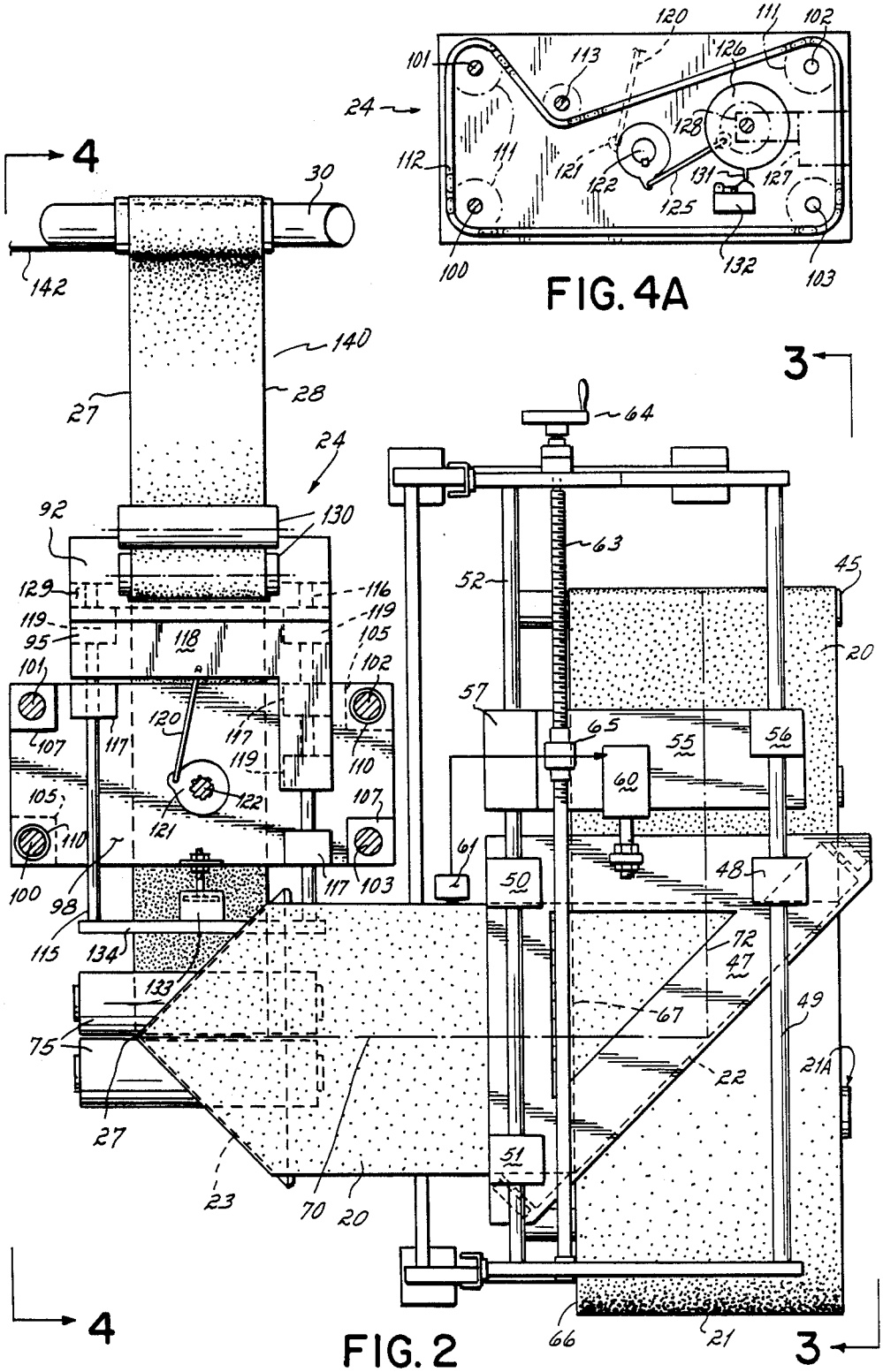
FIG. 2 is an enlarged plan view, partially in cross section, of the area of the machine delineated by the box 2—2 of FIG. 1.
FIG. 4A is a top plan view of the sealing section drive as seen on lines 4A—4A of FIG. 4.
Figure 3:
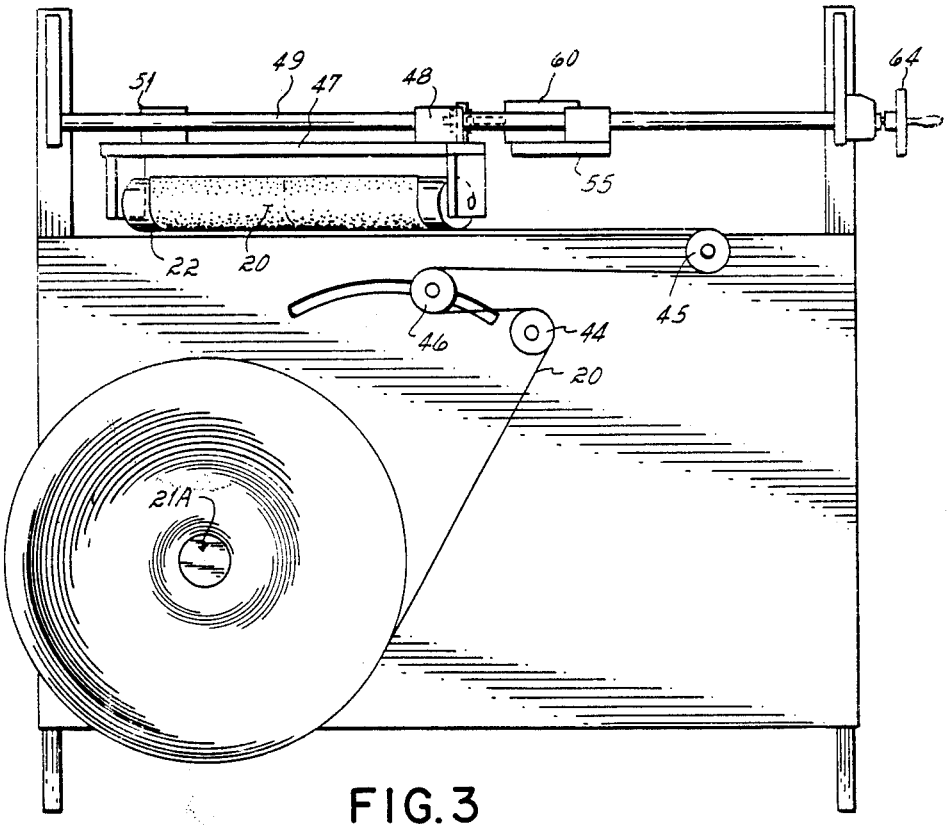
FIG. 3 is an end elevational view of the apparatus illustrating the supply roll and its feed onto the turning bar as seen along lines 3—3 of FIG. 2.

Referring to FIGS. 2 and 3, web 20 is fed from the supply roll 21 over idler rolls 44 and 45 and an intermediate dancer roll 46. From the idler roll 45, the web passes over the turning bar 22. The turning bar 22 is rigidly mounted on a carriage 47. The carriage carries a bearing 48 that is slidable on a rod 49. The carriage carries two bearings 50 and 51 that are slidable on a rod 52. The carriage 47 is connected to a drive plate 55 mounted by bearings 56, 57 on the respective rods 49 and 52. The plate 55 is connected by an edge guide actuator 60 to the carriage 47. The edge guide actuator is controlled by an edge sensor 61 which causes the edge guide to vary the distance between the plate 55 and the carriage 47 depending upon the movement of the edge of the web 20 as it moves toward the plow 23. A screw 63 operated by a crank 64 is threaded onto a nut 65 fixed to the plate 55. It can be seen that by rotating the screw 65, the assembly of plate 55 and carriage 47 will move along the rods 49 and 52, carrying the turning bar 22 on the carriage 47.

Figure 2A:
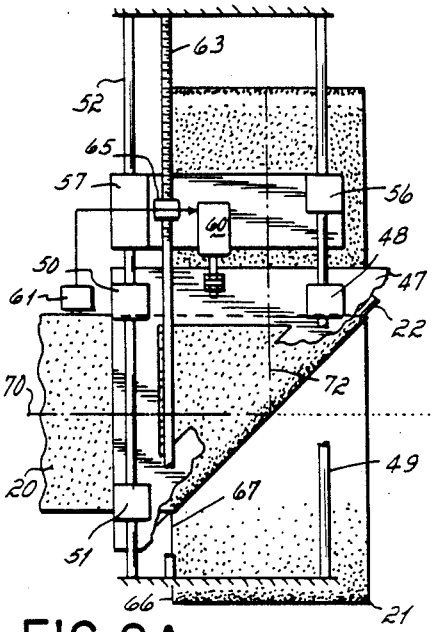
FIGS. 2A and 2B are plan views, reduced in scale, depicting the operation of the turning bar.
Figure 2B:
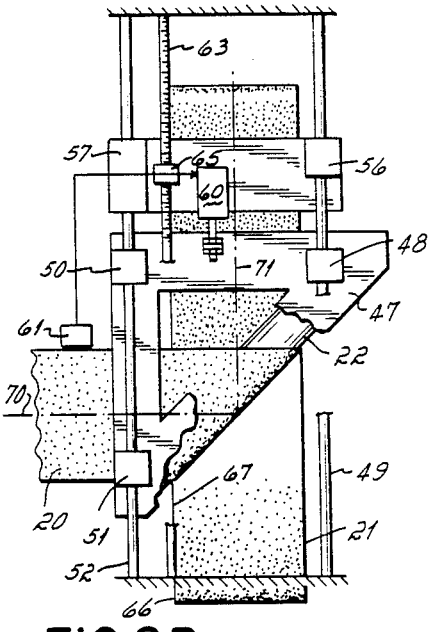

Referring to FIGS. 2A and 2B, the effects of moving the turning bar 22 through movement of the carriage 47 can be seen. Every supply roll is mounted on the supply roll arbor 21A with its inner side 66 at the inner side of the supply roll stand coinciding with a plan 67. The plow 23 has a centerline 70 with which the centerline of the web must be aligned to form a pouch of uniform sidewalls. In FIG. 2B, the centerline of the small width supply roll indicated at 71 is at a distinctly different position from the centerline 72 of the larger supply roll indicated in FIG. 2A. However, by shifting the position of the turning bar from the position of FIG. 2B to the position of FIG. 2A, the centerline of the small supply roll will be the same as the centerline of the large supply roll as the web leaves the turning bar 22 and approaches the plow 23 having a centerline 70. The edge sensor 61 fine tunes the apparatus to take into consideration variations in the positioning of the web as it comes off the supply roll during the continuous operation of the machine.

The Intermittent Transverse Sealing Apparatus

Figure 4:
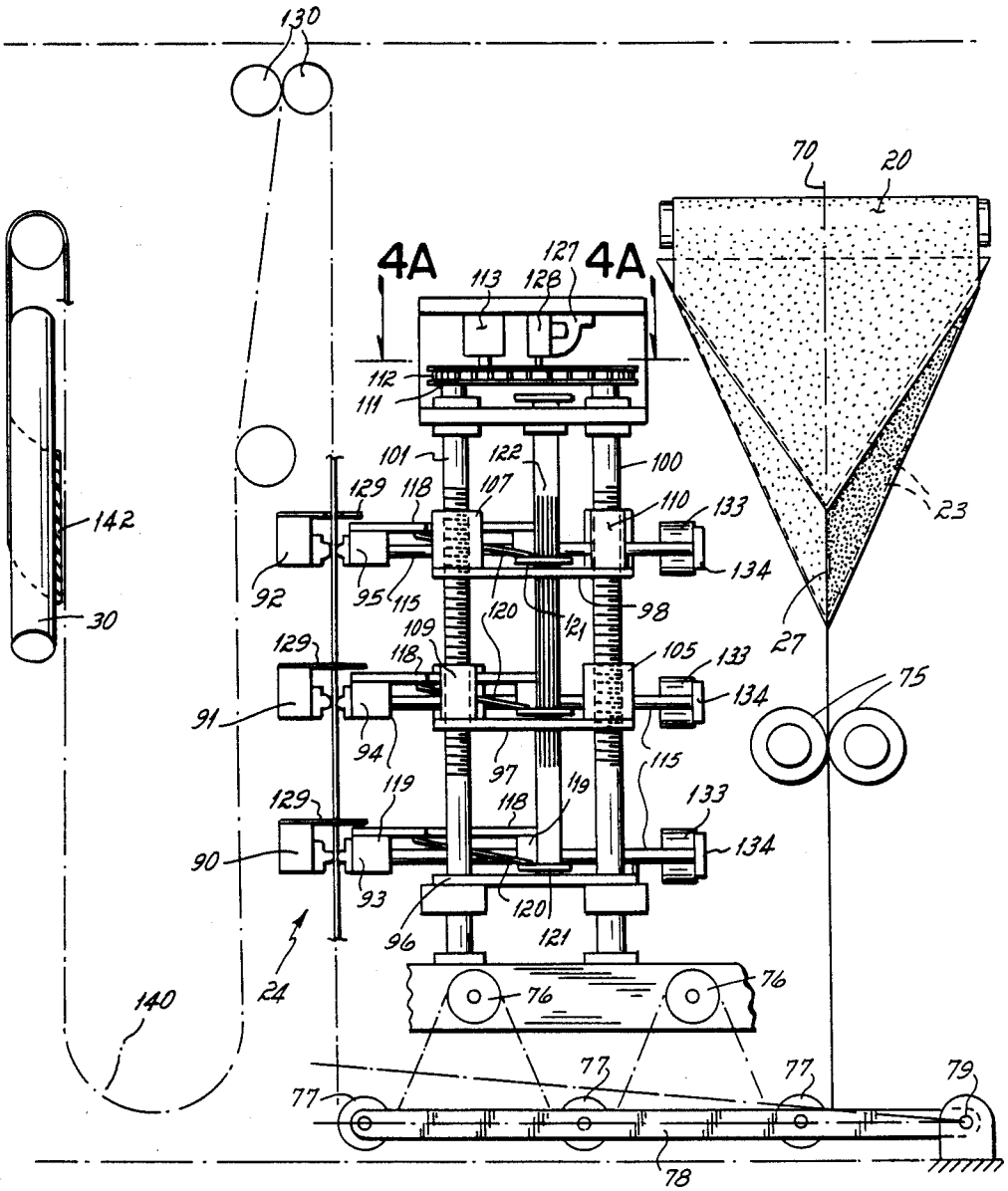
FIG. 4 is an elevational view of the transverse sealing section as seen along lines 4—4 of FIG. 2.

Referring to FIGS. 2, 4, and 4A, the folded web 20 is pulled over the plow 23 by passing through the nip of pull rolls 75. The web is fed over upper fixed rolls 76 and lower dancer rolls 77. The lower dancer rolls are mounted on a bar 78 pivoted at its end 79 so that it can swing back and forth to accommodate a change from continuous motion coming through the pull rolls 75 to an intermittent motion in the sealing section 24, as will be described.

The web 20 is transversely sealed by three fixed jaws 90, 91 and 92 that cooperate with three movable jaws 93, 94 and 95. The jaw assemblies 90–95 are carried on plates 96, 97 and 98. The plate 96 is vertically fixed. When there is an adjustment to be made between the jaws to create a different pouch length, plate 98 is moved twice the distance as plate 97. To support the plates and effect the movement for adjustment, the plates are mounted on four screws 100, 101, 102 and 103. Diagonally-opposed screws 100, 102 have exactly one-half the thread pitch as diagonally-opposed screws 100, 103. Screws 100, 102 are engaged by diagonally-opposed nuts 105 mounted on plate 97. Diagonally-opposed screws 101, 103 are engaged by diagonally-opposed nuts 107 mounted on plate 98. Plate 97 also carries two diagonally-opposed bushings 109 that slidably engage the screws 101 and 103. Similarly, plate 98 carries diagonally-opposed bushings 110 that slidably engage the screws 100, 102. The upper ends of the screws carry sprockets 111 that are engaged by a chain 112.

Each plate 96–98 carries a pair of slidable rods 115, 116. The slidable rods are mounted to the plates by bearings 117. The fixed jaws 90–92 are mounted on the ends of the rods 115, 116, the rods being movable only at shutdown, as will be described. The rods carry an L-shaped plate 118 (FIG. 2) which is slidably mounted to the rods by bearings 119. Each plate 118 is connected by a link 120 to a lever 121 mounted on a spline shaft 122. Oscillation of the spline shaft 122 causes oscillation of the lever 121, the link 120 and, hence, the movable jaws 93–95 carried on plate 118. With reference to FIG. 4A, the oscillation of the spline shaft 122 is caused by connecting it to a link 125 which is connected to a cam 126 driven by a motor 127 through a gear box 128. Thus, operation of the motor 127 in timed relation to the movement of the web 20 causes the movable jaws 93–95 to move against the fixed jaws 90-92 forming, simultaneously, three transverse seals. After seals are formed, the web 20 is drawn by a servomotor-driven pull rolls 130 which are set to pull the web a precise length equal to the length of three pouches each time the jaws 90–95 are opened. To trigger the motor for rolls 130, the cam 126 carries a flag 131 that passes a sensor 132. When it passes the sensor, the sensor transmits a signal to the pull roll motor. The pull roll motor is set to operate a precise number of revolutions and does so when signalled.

The jaws 93-95 are heated by an electrical system, not shown. At shutdown, it is useful to move the web out of the way of the heated jaws. To this end, the fixed jaws 90–92 carry a slotted plate 129 through which the web 20 passes. The fixed jaws are laterally movable with respect to the plates 96–98 by means of pneumatic piston and cylinder 133 that are connected between the plates 96–98 and a bar 134 connected across the rods 115, 116. At shutdown, the pneumatic piston and cylinder thrusts the fixed jaws 90–92 to the left as viewed in FIG. 4 with the slotted plates 129 carrying the film out of the way of the heated movable jaws 93–95.

From the intermittent operated pull rolls 130, the web changes from intermittent motion back to continuous motion. A festoon 140 is provided for that purpose. The web passes over a turning bar 30 to change from its vertical path to a horizontal path as if coming out of the sheet of drawings at 142 in FIG. 4 and moving left in FIG. 2.

Register and Cutting Apparatus

Figure 5:
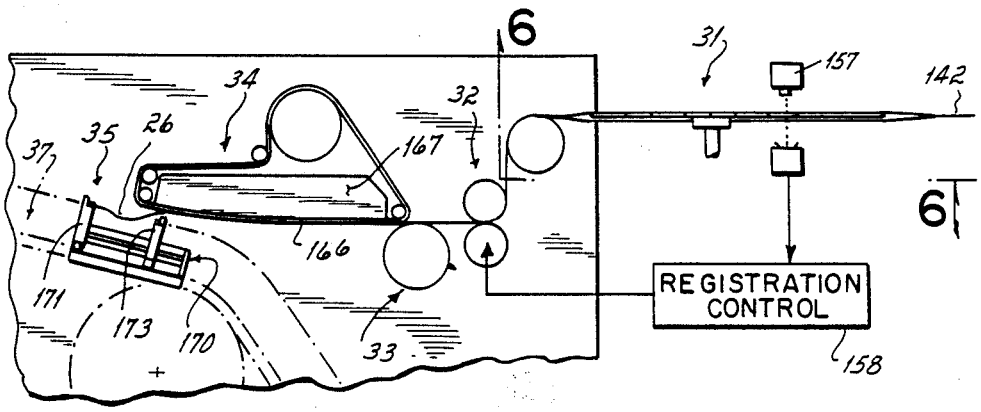
FIG. 5 is an enlarged plan view of the portion of the machine delineated by the box 5—5 of FIG. 1.
Figure 6:
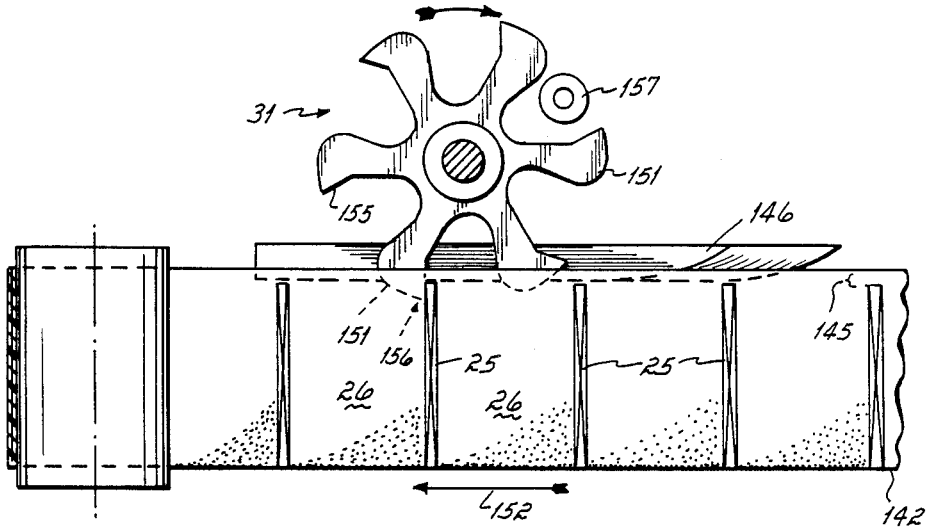
FIG. 6 is an elevational view taken along lines 6—6 of FIG. 5.

Referring to FIGS. 5 and 6, the web 20 is shown to have transverse seals 25. The seals do not extend transversely across the whole web, but rather leave a small fraction of an inch of lip 145 at the top of the web. A spreader blade 146 engages the top edge of the web between the lips 145 to spread open the mouth 28 of each pouch. The walking star 31 has six legs 151, each of which penetrates a respective pouch 26 as the pouch passes the walking star moving in the direction of the arrow 152. Each leg has a surface 155 which is engaged by the trailing seal 25 of each pouch, as shown particularly at 156 in FIG. 6. That leg at 156 identifies precisely the location of the leading edge of the seal 25. The position of that leg and, hence, the seal is monitored by a photoelectric eye 157. The signal from the electric eye 157 is fed through a registration control 158 to control the registration rolls 32. The signal as created by the position of the walking star will determine whether the seal needs to be advanced or retarded in order to be precisely cut through its center by the rotary knife 33. Pouches cut from the web are carried by the vacuum conveyor 34 which includes a perforated conveyor belt 166 that passes over a vacuum plenum 167 to hold the vacuum on the pouches as the pouches are conveyed to the gripper 35.

The Gripper Unit

Figure 7:
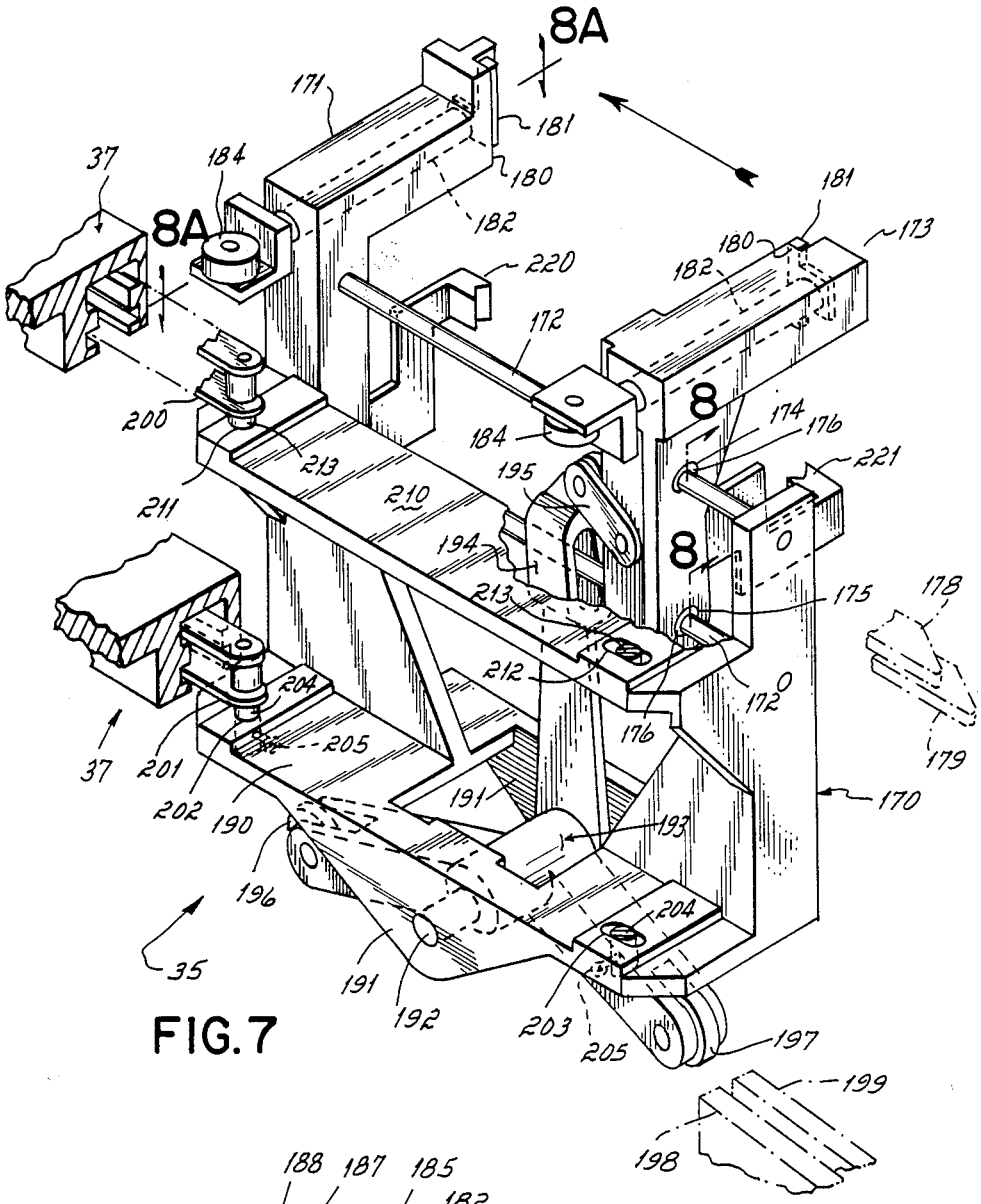
FIG. 7 is a perspective view of the gripper unit.
Figure 8A:
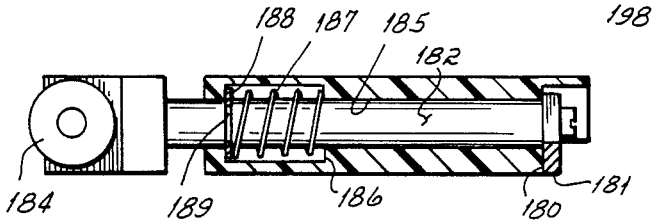
FIG. 8A is a cross-sectional view taken along lines 8A—8A of FIG. 7.
Figure 8:
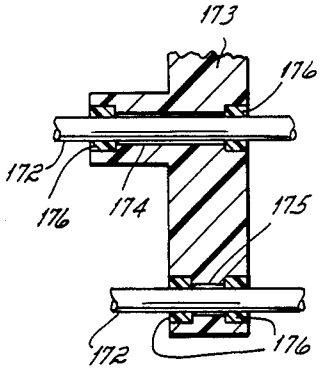
FIG. 8 is a cross-sectional view taken along lines 8—8 of FIG. 7.

With reference to FIGS. 7, 8 and 8A, the gripper 35 has a molded plastic frame 170 which includes, integrally molded with it, a leading fixed jaw 171. The frame has a pair of vertically-spaced horizontal rods 172 to which a trailing jaw 173 is slidably mounted. The trailing jaw is a molded plastic element having an upper bore 174 and a lower bore 175. Each end of each bore is closed by neoprene grease seals 176. In this instance, the grease seals do not keep grease in, but rather keep dirt out of the bores 174, 175 and maintain a frictional grip of the movable jaw on the rods 172.

Each jaw has a fixed clamp 180 and a movable clamp 181. The movable clamp 181 is mounted on the end of a rod 182, the other end of which 183 carries cam follower roller 184. The rod 182 is slidable in a bore 185 in the molded plastic element. The bore 185 has a shoulder at 186 against which a compression spring 187 bears. The compression spring engages a snap ring 188 that is snapped into an annular groove 189 on the rod 182. The compression spring 187 securely holds the movable clamp 181 against the fixed clamp 180, thereby holding the edge of a pouch securely in the jaw.

Figure 10:
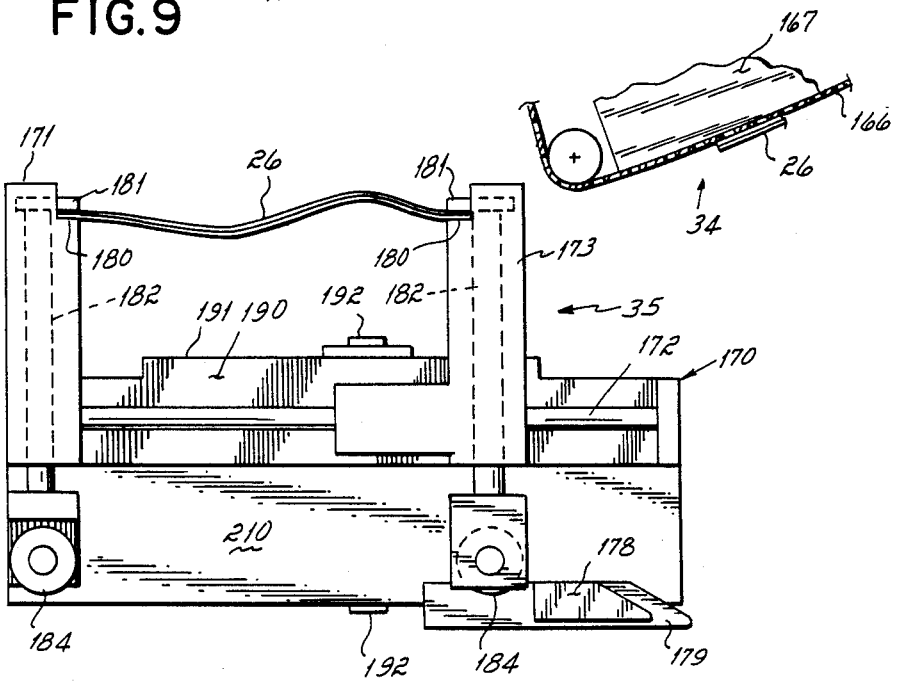
FIG. 10 is a view taken along lines 10—10 of FIG. 9.

The fixed jaw 171 is substantially identical to the movable jaw 173 except that the clamping element of the fixed jaw is L-shaped to permit the rod 182 of the fixed jaw to be at a lower position than the rod of the movable jaw. By vertically spacing the respective rods and followers, the jaws can be manipulated by respective vertically-spaced cams 178 and 179 without interference. Cams 178 and 179 are mounted adjacent the vacuum pouch conveyor 34 to capture a pouch and downstream from the sealing station 41 to release the pouch, as seen in FIGS. 1 and 10.

The lower end of the frame 170 has a horizontal flange 190. Two spaced depending flanges 191 are integral with the flange 190. The spaced flanges 191 carry a pin 192 on which a three-armed lever 193 is pivotally mounted. The lever 193 has an upwardly-extending arm 194 connected by a link 195 to the movable jaw 173. Below the pivot bolt 192, the lever has a leading follower 196 and a laterallyspaced trailing follower 197. The followers are engageable with respective laterally-spaced cams 198 and 199 to cause the trailing jaw 173 to move toward the fixed jaw when follower 197 engages cam 199 and to move away from the fixed jaw when follower 196 engages cam 198.

A plurality of gripper units 35 are mounted in uniformly-spaced relation to the conveyor 37. The conveyor 37 has an upper chain run 200 and a lower chain run 201. The horizontal flange 190 has a leading hole 202 and a spaced trailing slot 203 adapted to receive spaced pins 204 that are fixed to the lower run 201. Hairpin pins 205 secure the unit 35 to the pins 204.

Spanning the central portion of the frame 170 is an upper horizontal flange 210. The upper flange has a leading horizontal hole 211 and a trailing horizontal slot 212 that receive pins 213 on the upper chain run 200 of the conveyor 37.

The conveyor chains are adapted to carry gripper units 35 of different sizes. If the gripper unit is a six-inch pitch, that is, it is mounted on pin sets that are spaced six inches apart, it is suitable for handling pouches within an infinite number of sizes within a range of about 2.5 inches to 4.5 inches in length. A nine-inch pitch gripper will handle pouches of an overlapping range of sizes.

Because the leading jaw 171 is fixed and the trailing jaw 173 is slidable on parallel bars, the jaw openings always remain parallel to one another regardless of the size of pouch with which the jaws are to be used. Further, the jaws are parallel to each other when the pouch is pulled tight as well as when the pouch is fully opened.

The pouch has its greatest capacity when opened to a cylindrical cross section. To approach the cylindrical cross section, the side edges of the pouch must remain parallel to each other. For this purpose, the jaws may be provided with optional side guides 220 and 221 mounted on the fixed leading jaw and trailing jaw, respectively.

Pouch Forming, Filling and Sealing Apparatus

Figure 9:
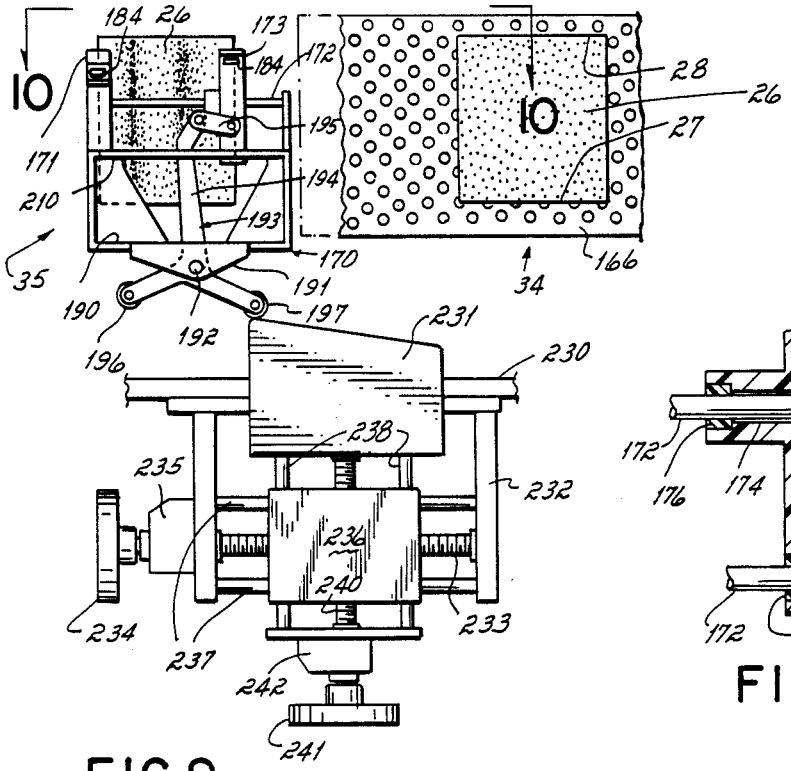
FIG. 9 is an elevational view of the portion of the machine delineated by lines 9—9 of FIG. 1.

The organization and operation of a pouch form, fill, seal apparatus should be read in conjunction with FIG. 1. The first station is illustrated in FIGS. 9 and 10. The apparatus has a base structure supporting all of the moving parts, the base structure being diagrammatically illustrated at 230 in FIG. 9. A ramp cam 231 (like cams 198, 199) is mounted near the downstream end of the conveyor 34. The cam 231 is in the path of a trailing follower 197. The cam 231, like all of the gripper jaw operating cams that will be hereinafter described, has a fixed bracket 232 to which a horizontal screw 233 is rotatably mounted. The screw has a hand knob 234 with a digital counter 235 permitting it to be set repeatably for various pouch sizes. A block 236 is threaded to the screw 234 and is slidable on ways 237. The block 236 carries vertical ways 238 at the upper end of which the cam 231 is mounted. A screw 240 is connected at its upper end to the cam 231 and is threaded into the block 236 so that rotation of the screw 240 with respect to the block 236 will raise and lower the cam 231. The screw is connected to a hand knob 241 and a digital counter 242 for repeatably setting the vertical position of the cam. The horizontal movement of the cam 231 determines the point on the conveyor system at which movement of the trailing jaw occurs. Vertical movement of the cam determines the extent of the longitudinal movement of the trailing jaw.

The movable clamps 181 of the jaws 171, 173 are operated by respective cams of the type diagrammatically shown in FIG. 7 at 178 and 179. As shown in FIG. 10, an upper cam 178 operates the trailing clamp. The lower cam 179 operates the leading clamp of the fixed jaw. As reflected in FIGS. 9 and 10, a pouch is brought into contact with the leading fixed jaw while it is held open by the cam 179. It comes into the leading jaw 171 at a velocity slightly greater than the velocity of the jaw so that the pouch bows slightly as it engages the open jaw, thereby providing assurance that the leading edge of the pouch is precisely positioned on the jaw. The trailing jaw 173 is, at the instant the pouch engages the leading jaw, spaced behind the trailing edge of the pouch. The cam 231 that it engages causes the trailing jaw to catch up to the trailing pouch edge. As the trailing pouch edge is about to enter the jaw 173, the rear clamp 181 is opened by the rear cam 178. The clamp is thereafter closed on the pouch in its slightly pulled condition. The pouch is at this point, immediately downstream of the conveyor 34, securely clamped between the two jaws of the gripper unit and in condition for opening and filling.

Immediately after the leading and trailing edges of the pouch are gripped in the jaws 171, 173, the trailing jaw 173 is cammed rearwardly to a pre-opening position in which the pouch is almost stretched taut. That rearward movement of the trailing jaw 173 is caused by the cam 244 shown at the right side of FIG. 11. Cam 244 engages the leading follower 196 to move the jaw 173 slightly rearwardly with respect to the leading jaw 171.

Figure 11:
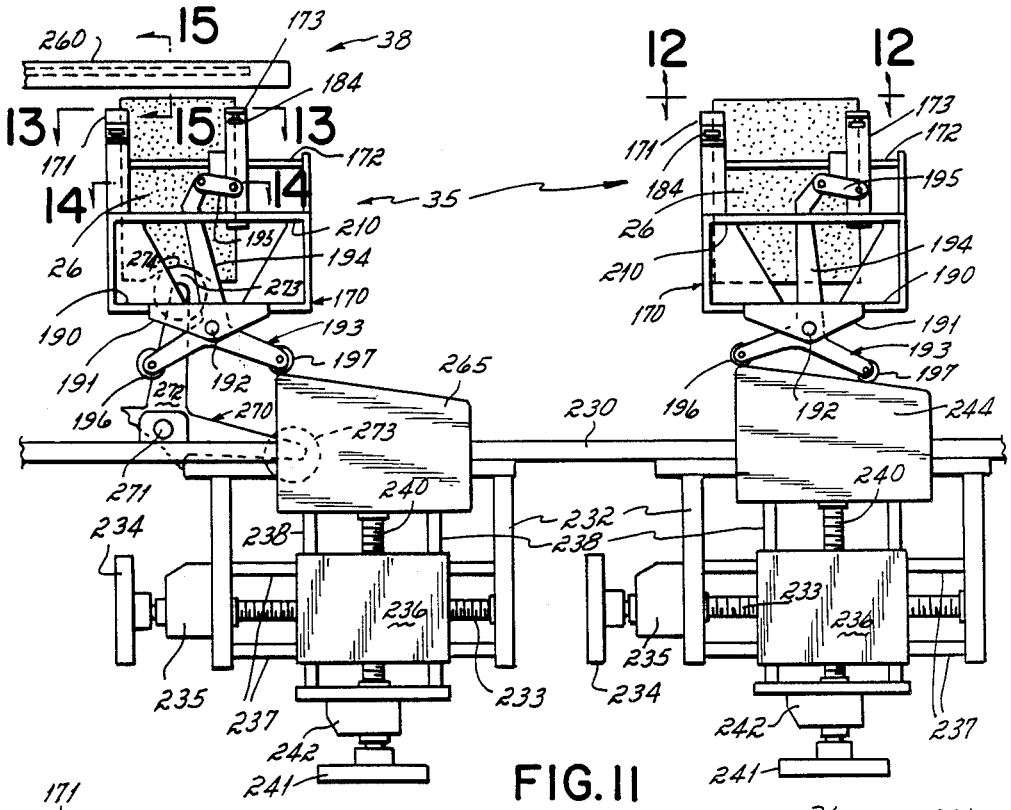
FIG. 11 is an elevational view of the area delineated by the lines 11—11 of FIG. 1.
Figure 12:
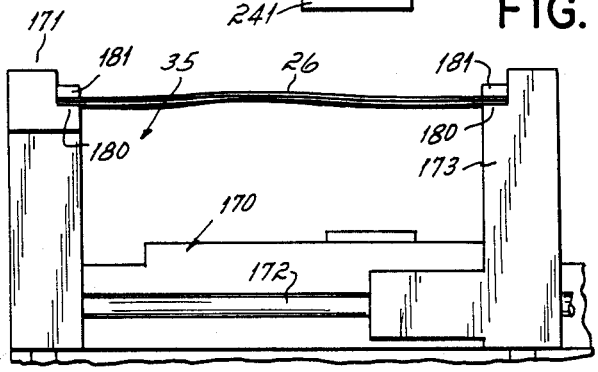
FIG. 12 is a plan view taken along lines 12—12 of FIG. 11.
Figure 14:
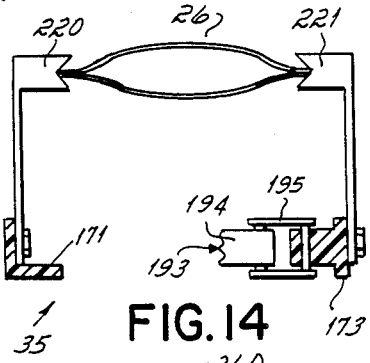
FIG. 14 is a cross-sectional view taken along lines 14—14 of FIG. 11.
Figure 13:
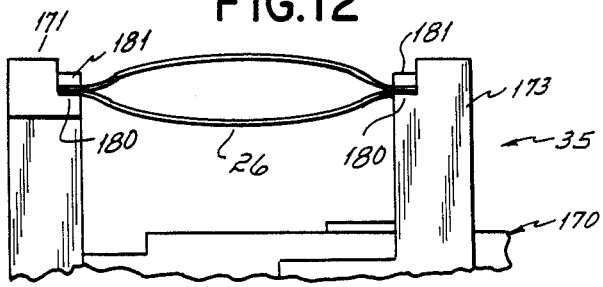
FIG. 13 is a plan view taken along lines 13—13 of FIG. 11.
Figure 15:
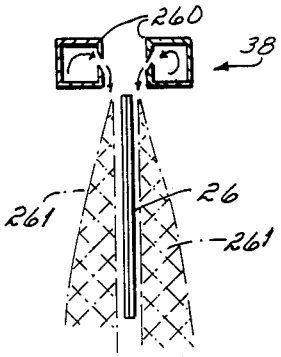
FIG. 15 is a cross-sectional view taken along lines 15—15 of FIG. 11.

The gripper 35 carries the pouch toward the filler 40 and through an opening station 38. At the opening station 38, as depicted at the left of FIG. 11, the pouch passes under a pair of elongated air tubes 260, shown in cross section in FIG. 15. The air tubes blow two patterns of air 261 down the sides of the pouch, thereby creating a low pressure area on the surface of each pouch in accordance with Bernoulli's principle. The atmospheric air on the inside of the pouch will cause the pouch walls to move outwardly, as shown in FIG. 13. In position below the air tubes 260 is a pouch opening cam 265. It is laterally positioned to engage the trailing follower 197 to cause the trailing jaw 173 to move toward the leading jaw 171, thereby bringing the pouch edges toward one another to permit the opening of the pouch to the fullest extent desired for the product which it is to receive at the filling station. The change of relationship of the jaws is depicted in FIGS. 12 and 13. As shown in FIG. 14, the optional side guides 220 and 221 engage the lower portion of the pouch at its edges to move them together along with the top edges that are held in the jaws 171 and 173.

At the opening station, a tuck bottom actuator 270 is rotatably mounted at 271 to the base 230. The actuator has four arms 272, each terminated in a roller 273 that is engageable with the bottom of each pouch, as indicated at 274 in FIG. 11. The actuator is driven in timed relation to the conveyor to bring a tuck wheel 273 into engagement with the bottom of each pouch as it enters the opening station, thereby increasing the capacity of the pouch.

After the jaws 171 and 173 are cammed to the correct spacing, the jaws remain in the position in which they are cammed until cammed to a different position. The frictional engagement of the seals 176 to the rods 172 assures that that relationship is maintained. The thus-open pouches are conveyed around a conventional filler 40 having an inclined spoutcarrying wheel that moves each spout into a respective pouch as the inclined wheel makes its excursion around the circular filler. When the spout has entered the pouch, a metered amount of product passes through the spout into the pouch. The spout is then carried out of the pouch as the pouch leaves the wheel. The operation of the gripper unit as it leaves the filling wheel is simply to open the jaws to the pouch length substantially as depicted in the right side of FIG. 11 and in FIG. 12. The spacing of the jaws at preopening, depicted at the right side of FIG. 11, is just slightly less than the distance between jaws after filling. After filling, the jaws stretch the upper edges of the pouch at the mouth, as shown in FIG. 12. The upper edges of the pouch are then conveyed in that attitude through a linear heater which brings the temperature of the thermoplastic material of the free edges to a fusion temperature. The pouches are then conveyed through crimping wheels 280 to complete the seal, all of which takes place at the closing and sealing station 41.

Downstream of the crimping wheels 280 of station 41 is the discharge station 42 which includes a pair of upper and lower release cams 178, 179 that engage the respective followers 184 on the leading and trailing jaws 171, 173 to open the jaws. Simultaneously with the opening of the jaws, vacuum cups 283 on a spider 284 engage and pick individual pouches off the gripper units and deposit them for future handling.

After the pouches are released, a final cam 285 identical to cam 244 is engaged by follower 196. The cam is set to engage the leading follower to open the jaws to their original condition ready to receive a new pouch.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A gripper unit for gripping the sealed edges of flat pouches comprising:

a frame having opposed vertical sides, vertically spaced horizontal bars fixed in said vertical sides, a leading gripping jaw fixed to one of said vertical sides, a trailing gripping jaw slidably mounted on said bars and frictionally gripping said bars, means for sliding said trailing jaw on said bars to position it for pouch opening and filling operations.

2. A gripper unit as in claim 1 in which said sliding means comprises:

a lever pivoted to said frame at its lower end, the upper end of said lever being connected to said trailing gripping jaw, forward and rearward cam followers fixed to and projecting fore and aft .from said lever at the lower end thereof, said cam followers being selectively engageable by stationary ramp cams to cause said lever to swing and carry with it said trailing gripping jaw.

3. A gripper unit as in claim 1, each said gripping jaw having a fixed clamp, a movable clamp mounted on a transverse slidable rod, and a spring urging said rod in a direction to close said movable clamp on said fixed jaw, a follower mounted on the end of said rod remote from said clamp for engagement with a cam for opening said clamps.

4. A gripper unit as in claim 1 further comprising:

a side guide below each gripping jaw, said side guides being engageable with the side edges of a pouch to maintain said pouch side edges parallel as said trailing jaw is moved toward said leading jaw to open said pouch for filling.

5. A gripper unit for gripping the sealed edges of flat pouches comprising:

a frame having opposed vertical sides, vertically spaced horizontal bars fixed in said vertical sides, a leading gripping jaw fixed to one of said vertical sides, a trailing gripping jaw slidably mounted on said bars and frictionally gripping said bars, means for sliding said trailing jaw on said bars to position it for pouch opening and filling operations, said trailing jaw having two bores that receive said horizontal bars, said sliding means being disengageable from said trailing jaw, said bores having, at each end, seals that grip said horizontal bars and apply the necessary friction to retain said trailing jaw in any position on said bar to which it is moved while said sliding means is disengaged.

6. A gripper unit as in claim 5 in which said seals are neoprene grease seals.

7. A gripper unit for the side edges of pouches in an adjustable pouch machine comprising:

a molded plastic frame that includes a fixed jaw, a pair of steel rods extending across said frame, a molded plastic movable jaw slidably mounted on said rods toward and away from said fixed jaw, a molded plastic lever pivotally mounted in the lower portion of said frame, said lever having an upwardly-projecting arm connected by a link to said movable jaw, said lever having downwardly-projecting forward and rearward followers which, when passing over a cam, will cause said movable jaw to move selectively toward or away from said fixed jaw.

8. An adjustable pouch filing machine comprising:

a filler, an endless chain conveyor having a section passing adjacent said filler, means for driving said chain conveyor, a plurality of gripper units mounted on said chain conveyor in spaced relation, each said gripper unit having a frame, a leading gripping jaw on said frame, a movable trailing gripping jaw, at least one cam follower on said trailing jaw, a plurality of cams mounted adjacent said chain conveyor in the path of said follower to move said trailing jaw to the desired position with respect to said leading jaw and then disengage from said cam follower, said trailing jaw being frictionally mounted on said frame to maintain any position to which it is moved while said cam actuating means is disengaged, and means for adjusting the position of said cams whereby to adjust the positioning of said trailing jaw and thereby to accommodate pouches of varying lengths.

9. A machine as in claim 8 further comprising:

feeding means for feeding pouches one at a time into a gripper unit as said gripper unit passes said feeding means, said feeding means imparting a velocity to each said pouch that is slightly greater than the velocity of said leading gripper jaw whereby a leading edge of said pouch catches up to and engages said leading gripper jaw.

10. A machine as in claim 9 in which a cam is positioned adjacent said feeding means for engagement by each follower to cause said trailing gripper to catch up to and engage a trailing edge of said pouch, and cam means opening and closing said gripper jaws to capture said pouch edges when they engage respective gripper jaw.

11. A machine as in claim 10 further comprising:

an elongated Bernoulli blower adjacent said feeding means for blowing air downwardly across opposed sides of said pouches to create low pressure areas on said pouch surfaces, and cam means engaging said follower to bring said trailing jaw toward said fixed jaw whereby the combination of air and jaw movement opens each pouch for filling.

12. A machine as in claim 8, wherein said trailing jaw has two laterally-spaced and longitudinallyspaced followers, one follower when cammed upwardly tends to close said jaws, the other follower when cammed upwardly tends to open said jaws.

13. A machine as in claim 8 in which said chain conveyor has upper and lower parallel runs, said gripper unit frame having upper and lower horizontally-projecting flanges, and vertical pins on said chains projecting into said flanges to provide a quick release and mount attachment of each gripper unit to said chains.

* * * * *